United States Patent [19]

Sakuyama et al.

[11] Patent Number: 4,581,077

[45] Date of Patent: Apr. 8, 1986

[54] METHOD OF MANUFACTURING ROLLED TITANIUM ALLOY SHEETS

[75] Inventors: Hideo Sakuyama; Ichiro Sawamura, both of Toda; Michio Hanaki, Samukawa; Chiaki Ouchi; Hiroyoshi Suenaga, both of Yokohama, all of Japan

[73] Assignee: Nippon Mining Co., Ltd., Tokyo, Japan

[21] Appl. No.: 725,454

[22] Filed: Apr. 22, 1985

[30] Foreign Application Priority Data

| | | | |
|---|---|---|---|
| Apr. 27, 1984 | [JP] | Japan | 59-84058 |
| May 4, 1984 | [JP] | Japan | 59-88361 |
| Oct. 30, 1984 | [JP] | Japan | 59-226884 |

[51] Int. Cl.[4] ..... C22F 1/18

[52] U.S. Cl. ..... 148/11.5 F; 148/12.7 B

[58] Field of Search ..... 148/11.5 F, 12.7 B

[56] References Cited

U.S. PATENT DOCUMENTS

| | | | |
|---|---|---|---|
| 3,492,172 | 1/1970 | Sauvageot et al. | 148/11.5 F |
| 3,575,736 | 4/1971 | Fitzpatrick et al. | 148/11.5 F |
| 3,649,374 | 3/1972 | Chalk | 148/11.5 F |
| 4,053,330 | 10/1977 | Henricks et al. | 148/11.5 F |

*Primary Examiner*—Wayland Stallard

*Attorney, Agent, or Firm*—Seidel, Gonda, Goldhammer & Abbott

[57] ABSTRACT

A method of manufacturing a rolled titanium alloy sheet comprises breaking down an $\alpha$ or $\alpha+\beta$ titanium alloy ingot into a slab, working the slab in sequential stages of (A) cross rolling the slab in the $\alpha+\beta$ region under a condition of a reduction ratio of at least 1.2 and a cross rolling ratio of 0.6 to 1.4, (B) annealing the workpiece for recrystallization at a temperature 20° to 100° C., preferably 20° to 70° C., below the $\beta$-transus of the alloy, and (C) further cross rolling it in the $\alpha+\beta$ region under a condition of a reduction ratio of at least 1.6 and a cross rolling ratio of 0.6 to 1.4, and thereafter heat treating the rolled workpiece for annealing, solution treatment and aging or the like, depending on the intended use of the product. The method may include an additional stage (D) of repeating stages (B) and (C) at least once each. The ingot breakdown is preferably carried out by forging or rolling at a temperature of the two-phase $\alpha+\beta$ region to a total draft of at least 30%. The heating prior to the hot rolling operations is preferably effected in an atmosphere at a partial pressure of oxygen of 0.02 atm. or below.

9 Claims, No Drawings

METHOD OF MANUFACTURING ROLLED TITANIUM ALLOY SHEETS

BACKGROUND OF THE INVENTION

This invention relates to a method of manufacturing rolled titanium alloy sheets, and more specifically to a method of manufacturing rolled titanium alloy sheets with excellent strength and ductility, having a uniform, equiaxed $\alpha$ crystal structure free from anisotropy and prevented from undergoing surface cracking during the process of hot rolling.

Titanium alloys, which combine high specific strength with outstanding corrosion resistance, have enjoyed a steady increase in usage in the aircraft and space industries and also in ground fields for applications in various installations. The widespread usage has brought with it the development of many different titanium alloys, including Ti-Al-V, Ti-Al-Sn, Ti-Mn, Ti-Al-Mn, Ti-Al-Mo-V systems, etc..

Titanium alloys form a group of materials difficult to work, and the literature on the manufacture of their worked products has been rather scanty. Generally, however, it is believed that an equiaxed $\alpha$ crystal structure excellent in mechanical properties can be obtained by working the alloys through forging or rolling with the highest possible degree of working done in the $\alpha+\beta$ region. In connection with forgings, it has been reported that combining forging operation in excess of a given rate of working with heat treatment at a $\beta$-region temperature renders it possible to refine and uniformalize the grain size of $\alpha$ grain (Japanese Patent Application Publication No. 8099/1981). As regards rolled products, it has been proposed to produce an isotropic, fine-grained crystal structure by coupling at least total draft 70% by hot rolling with a treatment for forming an equiaxed $\alpha$ crystal structure wherein cooling and reheating are carried out under the specified conditions (Japanese Patent Application Public Disclosure No. 25423/1983).

However, those methods of the prior art inevitably leave some partial $\alpha$ phase behind that is not of an equiaxed $\alpha$ crystal structure, thus presenting a reliability problem of the products. In the case of forgings, there are marked scatters of structure longitudinally of the forging direction and in the cross section. Even with rolled products it is known that, because the $\alpha$ phase of titanium alloys represents a hexagonal close-packed crystal structure, substantial mechanical anisotropy develops in the alloys with the directions of rolling and at right angles to the rolling direction. Titanium alloy products, designed for use in severe service environments such as high temperatures, strong corrosive attacks, and heavy loads, are required to exhibit high reliability. Since rolling is basically advantageous over forging in quality of products and in operation efficiency, it is essential to establish a titanium alloy rolling method which will largely control or eliminate the presence of residual $\alpha$ phase that does not form the equiaxed crystal structure, without inducing mechanical anisotropy, in order to meet the growing requirements there for in various fields.

SUMMARY OF THE INVENTION

It is an object of this invention to provide a method of manufacturing high-quality rolled titanium alloy sheets which meet the industrial requirements with remarkably improved product reliability and decreased mechanical anisotropy through reduction of the localized $\alpha$ phase that does not form an equiaxed crystal structure.

Generally, in making slabs, ingots are worked in the $\beta$-region where deformation resistance is limited. Titanium alloy sheets obtained by hot rolling these slabs usually are quite inferior in structural homogeneity and mechanical properties (elongation in particular) and have other problems such as surface cracking tendency.

It is another object of the present invention, in view of the foregoing, to provide a method of manufacturing titanium alloy sheets more homogeneous in structure than the conventional products and superior in elongation and other mechanical properties.

As a result of our investigations about the hot workability of titanium alloys, it has now been found that those materials possess good hot workability (intrinsic processability) in themselves, posing no problem in hot working, for example, by vacuum heating. It has also been found that the surface cracking on hot rolling is attributable to the surface oxidation of the titanium alloy slab due to heating for rolling, and that the surface cracking can be successfully precluded by controlling the atmosphere in which the slab is heated for rolling.

In order to heat a titanium alloy slab for rolling into plate, or for hot rolling, a batch or continuous furnace is usually used. Either furnace employs an oxidizing atmosphere to prevent hydrogen absorption by the slab during heating. Consequently, oxide scale and oxygen-enriched layer develop on the slab surface, rendering the surface increasingly susceptible to cracking during the hot rolling operation.

The present invention is based on these findings, and therefore another object of the invention is to provide a method whereby the atmosphere for use in heating the slab for rolling is controlled to inhibit the formation of oxide scale and an oxygen-enriched layer on the slab surface and thereby prevent surface cracking during hot rolling more effectively than heretofore.

After the extensive research we have now found that (1) incorporating recrystallization annealing in the course of rolling materially reduces the proportion of the localized residual $\alpha$ phase that does not form an equiaxed crystal structure, and (2) cross rolling decreases mechanical anisotropy to a remarkable extent.

The recrystallization annealing and cross rolling must be performed under the temperature and rolling conditions within the specific ranges. Cross rolling operations with recrystallization annealing put in between make possible the manufacture of titanium alloy sheet free from localized residual $\alpha$ phase that does not form an equiaxed crystal structure, the sheet having an equiaxed $\alpha$ crystal structure with no mechanical anisotropy. The titanium alloy sheet thus obtained is improved in both strength and ductility and is usable with great reliability in heavy load services and in high temperature, and highly corrosive environments.

Briefly, the invention provides a method of manufacturing rolled titanium alloy sheets characterized by the steps of breaking down an $\alpha$ or $\alpha+\beta$ titanium alloy ingot into a slab, working the slab in three stages, that is, (A) cross rolling the slab in the $\alpha+\beta$ region under a condition of a reduction ratio of at least 1.2 and a cross rolling ratio of 0.6 to 1.4, (B) annealing the workpiece for recrystallization at a temperature 20° to 100° C. below the $\beta$-transus ($\beta$-transformation point) of the alloy, and (C) further cross rolling the workpiece in the $\alpha+\beta$ region under a condition of a reduction ratio of at least 1.6 and a cross rolling ratio of 0.6 to 1.4, and thereafter heat treating the rolled workpiece for annealing, solution treatment and aging, or the like depending on the intended use of the product.

In order to achieve further decreases in anisotropy and proportion of $\alpha$ phase that does not form an equiaxed crystal structure, the method may include an additional stage (D) of repeating at least once the sequence of stages (B) and (C).

In stage (B) above, the recrystallization annealing is performed preferably at a temperature 20° to 70° C. below the $\beta$-transus of the alloy.

The invention also provides a method which comprises breaking down an $\alpha$ or $\alpha+\beta$ titanium alloy ingot into a slab by forging or rolling at a temperature of the two-phase $\alpha+\beta$ region under a total draft of at least 30%, and then hot rolling the slab.

Further, a method is provided whereby the heating of the slab prior to hot rolling operations is carried out in an atmosphere at a partial pressure of oxygen of 0.02 atm. or below.

DETAILED DESCRIPTION OF THE INVENTION

The present invention will now be described in detail.

The titanium alloys to be worked in accordance with the invention may be of any types available provided they are $\alpha$ or $\alpha+\beta$ titanium alloys. Useful, besides the typical $\alpha+\beta$ alloy of Ti-6% Al-4% V, are Ti-6% Al-6% V-2% Sn, Ti-3% Al-2.5% V, Ti-8% Mn, Ti-4% Al-4% Mn, Ti-4% Al-8% Mo-1% V, Ti-4% Al-4% Mo-4% V, Ti-8% Al-1% Mo-1% V, Ti-6% Al-2% Sn-4% Zr-6% Mo, Ti-6% Al-2% Sn-4% Zr-2% Mo, Ti-5% Al-2.5% SN etc..

Rolled titanium alloy products are manufactured by a starting step of breakdown in which an ingot is slabbed or forged into a slab and following steps of rolling the slab into a sheet of predetermined dimensions and finally heat treating it for annealing, solution treatment and aging, or the like, for instance, depending on the intended use of the product. As stated above, the present invention is characterized by the rolling step between the ingot breakdown and final heat treatment steps. The rolling step consists of three stages:

(A) Cross rolling of the workpiece in the $\alpha+\beta$ region under a condition of a reduction ratio of at least 1.2 and a cross rolling ratio of 0.6 to 1.4, (B) Recrystallization annealing at a temperature 20° to 100° C. below the $\beta$-transus of the particular alloy, and (C) Cross rolling in the $\alpha+\beta$ region under a condition of a reduction ratio of at least 1.6 and a cross rolling ratio of 0.6 to 1.4.

For the purposes of the invention the terms "reduction ratio" and "cross rolling ratio" are defined as follows:

$$\text{Reduction ratio} = \frac{\text{Thickness of work before rolling}}{\text{Thickness of work after rolling}}$$

-continued $$\text{Cross rolling ratio} = \frac{\text{Ratio of reduction in direction normal to final pass direction}}{\text{Ratio of reduction in direction same as final pass direction}}$$

The "total draft" is expressed as:

$$\text{Total draft} = \frac{\text{cross sectional area before rolling} - \text{cross sectional area after rolling}}{\text{cross sectional area before rolling}}$$

Therefore, total draft can be calculated from the following conversion formula in terms of reduction ratio.

$$\text{Total draft (\%)} = \left(1 - \frac{1}{\text{Reduction ratio}}\right) \times 100$$

The slab obtained by ingot breakdown at a temperature above or below the $\beta$-transus of the alloy is first cross rolled in stage (A) to a reduction ratio of at least 1.2 (total draft of about 16.7%) and a cross rolling ratio of 0.6 to 1.4, so as to store up sufficient strain to provide a driving force for bringing both the $\alpha$ phase of Widmanstatten structure that resulted from the breakdown operation and the intergranular $\alpha$ phase that developed at the prior $\beta$ grain boundaries close to an equiaxed $\alpha$ crystal structure in the next stage (B) for recrystallization annealing. Cross rolling is a technique whereby the rolling direction is shifted through an angle of 90 deg. when the workpiece is subjected to successive rolling passes. The rolling temperature is not particularly specified provided that it is within the range of the $\alpha+\beta$ region. However, a range from about 50° to about 200° C. lower than the $\beta$-transus of the particular alloy is desirable. A temperature immediately below the $\beta$-transus can produce heat of working much enough to boost the metal temperature beyond that point, whereas too low a temperature causes the workpiece to crack on working. Attaining a high reduction ratio in stage (A) is beneficial for forming an equiaxed $\alpha$ crystal structure in stage (B). It is not necessary to produce a complete equiaxed $\alpha$ crystal structure here but greater importance is attached to breaking the $\alpha$ phase of Widmanstätten structure and intergranular $\alpha$ phase so as to form a crystal structure close to an equiaxed $\alpha$ crystal structure. This requires rolling under a reduction ratio of at least about 1.2. The upper limit of the reduction ratio depends on the type of alloy and temperature used, but a ratio up to about 8 to 10 is feasible without the danger of cracking. Usually, for the same reason as stated above, a value up to about 1.5 suffices for the purpose. The cross rolling in stage (A) is essential for the elimination of anisotropy in mechanical properties of the final product. It is true that ordinary straight rolling in stage (A) followed by cross rolling only in stage (C) gives a reasonably favorable effect. However, experiments have shown that the cross rolling in the first stage (A) is more helpful in yielding a quality product free from anisotropy but with good reliability. The cross rolling operation is performed in a cross rolling ratio of 0.6 to 1.4. The closer the ratio is to 1.0 the greater will be the effect of cross rolling, and cross rolling to any degree outside the range specified above is practically meaningless. Stage (A) may be regarded, in this sense, as a preliminary stage of treatment preparing for the final formation or perfection of an equiaxed $\alpha$ crystal structure.

The cross rolled workpiece is annealed for recrystallization at 20° to 100° C., preferably at 20° to 70° C., below the $\beta$-transus of the alloy. The $\beta$-transus varies with the type of alloy and, for instance, is about 1000° C. for the Ti-6% Al-4% V alloy, which is therefore annealed at 980° to 900° C. Annealing at any temperature higher than 20° C. below the $\beta$-transus will reduce the proportion of the proeutectic $\alpha$ phase sharply, deteriorating the mechanical properties of the final product. Conversely a temperature lower than 100° C. below the $\beta$-transus will be of little effect in that it fails to cause thorough recrystallization for forming an equiaxed $\alpha$ crystal structure. The annealing time depends on the type of alloy and temperature used but, in any case, has only to be long enough to effect fine recrystallization.

Although a mere combination of stages (A) and (B) gives a titanium alloy sheet with a fair proportion of equiaxed $\alpha$ crystal structure, it has been found that some partial $\alpha$ phase that does not form an equiaxed crystal structure remains always in the product. Use of a higher reduction ratio in stage (A) slightly decreases the number of $\alpha$ phase portions that do not form an equiaxed crystal structure. However, it is still not a complete solution of the problem, and the $\alpha$ phase of nonequiaxed crystal structure continues to remain inevitably.

In accordance with the invention, therefore, cross rolling is again carried out in stage (C) to build up internal strain so that the final heat treatment will produce more equiaxed $\alpha$ structure and reduce substantially the residual proportion of the $\alpha$ phase that does not form an equiaxed crystal structure. This effect is pronounced when the workpiece is cross rolled to a reduction ratio of at least 1.6 (total draft of 37.5%), usually 2 (50%) or upward. Moreover, for the elimination of anisotropy with respect to mechanical properties in the final process step, the cross rolling in stage (C) is indispensable. The effect of cross rolling in stage (C) is enhanced and rendered significant by the preliminary cross rolling in stage (A). The two cycles of cross rolling operation with the recrystallization annealing stage sandwiched in between is more effective in inhibiting the growth of anisotropy than the mere repetition of cross rolling. In stage (c) too the cross rolling ratio should come within the range of 0.6 to 1.4, and the nearer the value approaches 1.0 the better the effect. The workpiece temperature in stage (C) is not specially specified provided it is in the $\alpha+\beta$ region but, as in stage (A), it is desired to be about 50° to about 200° C. below the $\beta$-transus of the alloy.

In shifting from stage (B) to stage (C), the workpiece may be once cooled down to room temperature or may be directly fed to the latter stage.

The mechanism according to the invention for controlling the residual $\alpha$ phase that does not form an equiaxed crystal structure, described above, may be summarized as follows. In stage (A) the internal strain is built up and the $\alpha$ phase of Widmanstätten structure and intergranular $\alpha$ phase are destroyed; in stage (B) the equiaxed $\alpha$ crystal structure formation is encouraged; in stage (C) again the internal strain is accumulated; and by the final heat treatment the equiaxed $\alpha$ crystal structure formation is further promoted. The two opportunities offered for the equiaxed $\alpha$ crystal structure formation minimize the presence of the residual $\alpha$ phase that does not form an equiaxed crystal structure. At the same time, the two cross rolling operations, before and after the recrystallization annealing, provide the workpiece with isotropic mechanical properties. The cross rolling runs not only impart isotropy but also contribute to the formation of the equiaxed $\alpha$ crystal structure. The recrystallization annealing between these runs plays an important role in reducing the anisotropy as well as in controlling the presence of the residual $\alpha$ phase that does not form an equiaxed crystal structure. Thus, under the invention, the recrystallization annealing is combined with the prior and after cross rolling operations to achieve a synergetic effect to remove the $\alpha$ phase that does not form an equiaxed crystal structure and to eliminate the anisotropy of mechanical properties in a more perfect way.

It should be clear to those skilled in the art that, for the reasons stated, the objects of the invention are better realized by repeating stages (B) and (C) at least once each, for instance, in the order of stage (A)→(B)→(C)→(B)→(C)→final heat treatment.

For the manufacture of $\alpha$ or $\alpha+\beta$ titanium alloy sheet, an ingot is first worked by forging or slabbing into a slab and the slab is hot rolled.

The slabbing usually is performed in the $\beta$ region, and the hot rolling according to the invention applies to the slab making in the $\beta$ region.

It is often the case with conventional manufacture of a slab in the $\beta$ region that, for instance, due to slow cooling through a temperature range in the vicinity of the $\beta$- to or from $\alpha+\beta$-transformation point, coarse, intergranular $\alpha$ crystals precipitate at the prior $\beta$ grain boundaries in a network pattern, and part of them remains undestroyed by the hot rolling and subsequent heat treatment. The residue can effect adversely the structural homogeneity and mechanical properties of the resulting sheet.

No attempt has hitherto been made to control the working conditions in the slab making with due consideration paid for the material and structural characteristics of the slab. We have studied about the relations between the slab-making conditions and the structure and material of the resulting titanium alloy sheet. It has led to the findings that, in the course of slab making, intense working of the ingot at a temperature of the two-phase $\alpha+\beta$ region remarkably improves the structural homogeneity and mechanical properties such as elongation of the hot rolled workpiece. In order for the coarse, intergranular $\alpha$ crystals precipitated in a network pattern during slab making to disappear, recrystallization with attendant diffusion is essential. In this connection we have found that intense working at a temperature of the two-phase $\alpha+\beta$ region causes accumulation of strain energy in the slab, and the accumulated energy in turn accentuates the recrystallization during the course of reheating in the ensuing stage of hot rolling, thereby homogenizing the resulting metal structure. According to the present invention, therefore, the $\alpha$ or $\alpha+\beta$ titanium alloy ingot is forged or rolled into a slab at a temperature of the two-phase $\alpha+\beta$ region under a total draft of at least 30%, and the slab is reheated and hot rolled into a rolled titanium alloy sheet of excellent quality.

Our further investigations have revealed that even a more homogeneous structure is obtained after the heat treatment of a hot rolled sheet, by carrying out the hot rolling under working conditions of intense rolling at a temperature of the two-phase $\alpha+\beta$ region and, during the slab making process before the hot rolling, intensely working the slab at a temperature of the two-phase $\alpha+\beta$ region as above. The slab in which strain energy has been accumulated by the intense working at a temperature of the two-phase $\alpha+\beta$ region undergoes recrystallization upon the heating at the two-phase $\alpha+\beta$ region temperature that does not cause precipitation of the coarse, intergranular $\alpha$ crystals in a network pattern. As the slab that has been homogenized in structure in this way is hot rolled as intense working at a temperature of the two-phase $\alpha=\beta$ region, strain energy builds up in the slab and accelerates the recrystallization and makes the structure even more homogeneous in the subsequent step of heat treatment. It thus follows that if an $\alpha$ or $\alpha+\beta$ titanium alloy ingot is worked into a slab by forging or rolling at a temperature of the two-phase $\alpha+\beta$ region under a total draft of at least 30% and the slab is reheated to a two-phase $\alpha+\beta$ region temperature and then hot rolled again under a total draft of at least 30%, then a hot rolled sheet can be obtained which is protected against surface cracking and has more excellent surface properties than conventional products.

In the hot rolling operations under the invention a total draft of at least 30% is always attained satisfactorily.

An $\alpha$ or $\alpha+\beta$ titanium alloy shows a decrease in hot workability at a temperature of the two-phase $\alpha+\beta$ region. Therefore, if a slab in which coarse, intergranular $\alpha$ crystals remain in a network fashion is subjected to intense working in the $\alpha+\beta$ temperature range, mud-cracking often takes place on the work surface, starting with the network of coarse, intergranular $\alpha$ crystals. The present invention uses a slab free from such crystals as a workpiece to be hot rolled. Hence, surface cracking of the workpiece is prevented and a hot rolled sheet with excellent surface quality can be manufactured.

The conditions for manufacture according to the invention will now be explained.

First, an $\alpha$ or $\alpha+\beta$ titanium alloy ingot is heated to a temperature between 200° C. below the $\beta$-transus of the alloy and 100° C. above the same point. The ingot is continuously worked by forging or slabbing at a temperature of the two-phase $\alpha+\beta$ region under a total draft of at least 30%, without any forced cooling midway, to form a slab of predetermined dimensions. To heat the titanium alloy ingot either a batch furnace or continuous furnace is utilized. The heating temperature should be within the range specified above for the following reasons. If the temperature is more than 200° C. below the $\beta$-transus, the hot workability of the $\alpha+\beta$ titanium alloy is so poor that surface cracks develop and increased hot deformation resistance makes the rolling difficult. If the temperature is more than 100° C. above the $\beta$-transus, the titanium alloy ingot surface is seriously oxidized, resulting in increased scale loss and surface flaw development during rolling. In order to achieve the desired effect in this way, the working in the above-specified temperature range must be performed under a total draft of at least 30%. If the draft is less than 30%, the strain energy does not build up sufficiently to produce an effect of homogenizing the work structure during the hot rolling that follows. The slab obtained under these working conditions is cooled, reheated, and then hot rolled into a titanium alloy sheet.

The hot rolling of the titanium alloy slab into a sheet is carried out through stages (A) to (C) or further through an additional stage (D). In stages (A) to (C) a total draft of 30% or more is fully attained.

For heating the titanium alloy slab, either a batch furnace or continuous furnace is used. As stated already, the heating temperature is specified to be in the range of the two-phase $\alpha+\beta$ region on the following grounds.

According to this invention, recrystallization in the slab progresses until the structure is made homogeneous during the heating in the two-phase $\alpha+\beta$ region, by dint of the strain energy built up during the preceding process of slab making. If the slab is heated to a $\beta$ region temperature higher than that of the $\alpha+\beta$ region, the cooling from the $\beta$ region temperature is actually effected slowly from a temperature in the vicinity of the $\beta$- to or from $\alpha+\beta$-transus. This causes precipitation of coarse, intergranular $\alpha$ crystals in a network pattern at the prior $\beta$ grain boundaries, which in turn can eliminate the favorable effect of the invention on structural homogeneity. Also, if the slab is worked to a total draft of less than 30% at a temperature of the two-phase $\alpha+\beta$ region, the rolled sheet will not achieve a structure-homogenizing effect as expected from the subsequent heat treatment.

The heating prior to the hot rolling operation is controlled so that the partial pressure of oxygen is kept at 0.02 atm. or downward. This inhibits oxidation and scaling of the slab surface and further minimizes surface cracking due to the hot rolling.

There is no limitation to the heating temperature and time for the above process, which may be suitably chosen depending on the type of the $\alpha$ or $\alpha+\beta$ titanium alloy, mill capacity, thickness of the slab, and other factors. In any case a high rolling pressure applied in the low temperature range confers excellent mechanical properties on the rolled product.

The heating furnace is of any type capable of controlling the partial pressure of oxygen. For example, a vacuum furnace or a furnace that holds an Ar or He atmosphere may be employed.

After heating to the predetermined temperature under the foregoing conditions, the workpiece is hot rolled into a hot rolled sheet with fewer surface cracks than otherwise.

This invention is illustrated by the following examples.

Examples

Examples of the invention in which the present method was applied to a typical $\alpha+\beta$ titanium alloy, Ti-6% Al-4% V, and comparative examples wherein the same material was handled in accordance with other methods are summarized in Table 1.

The titanium alloy was cast into ingots 710 mm in diameter, with a $\beta$-transus of 1000° C.

Table 1 shows that in Example Nos. 1 to 5 of the invention, the anisotropies in the tensile directions L, T were extremely little, and the rates of nonequiaxed $\alpha$ crystal formation were 5.7% or less, indicating that the products had uniform equiaxed $\alpha$ crystal structures.

Rolling in the $\alpha+\beta$ region to a draft of 30% or more in the slab-making step and subsequent heating in an atmosphere with a partial pressure of oxygen not exceeding 0.02 atm. produced no length of surface crack on the as-rolled alloy pieces.

When workpieces were subjected to heating in air followed by rolling, some surface cracking developed even if the degree of the working was small. Also, in slab production step, when the rolling in the $\alpha+\beta$ region was not made, the increased number of the surface cracking was found in a subsequent rolling.

Cracks of the lengths given in the table are practically negligible when the workpieces were to be surface finished afterwards. However, the fewer the number of cracks, or the shorter the crack lengths, the better. Comparative Example Nos. 6 to 11 according to methods other than the present invention, especially No. 6, showed very high rates of nonequiaxed $\alpha$ crystal formation because of inadequate reduction ratios in the $\alpha+\beta$ region during the hot rolling operations.

Comparative Example No. 7 indicated substantial anisotropy in the tensile directions L and T due to insufficient cross rolling ratios used in the hot rolling runs. Without the working in the $\alpha+\beta$ region at the stage of slab making, the workpiece developed much surface cracking. Nos. 8 to 10, not subjected to recrystallization annealing or the second hot rolling, developed high degrees of anisotropy with respect to the straining directions and created extremely high percentages of nonequiaxed $\alpha$ crystal structure. No. 11 which used much higher recrystallization annealing and hot rolling temperatures than those according to the present invention, all exceeding the $\beta$-transus of the alloy, was almost entirely composed of nonequiaxed crystals and quite inferior in structure.

As will be clearly understood from the examples of the invention and reference examples for comparison, the method of the invention for the manufacture of titanium alloy sheets is excellent in that it almost completely eliminates the anisotropy with respect to the tensile directions of rolling and create homogeneous, equiaxed $\alpha$ crystal structures in the products.

TABLE 1

| Example No. | Slab-making conditions (finished thickness 160 mm): Heatg temp., °C. | Finish temp., °C. | $\alpha$-$\beta$regn draft, % | Heatg temp., °C. | Heatg furnace | 1st rolling conditions (hot rolling): Finish temp., °C. | $\alpha$-$\beta$regn reducn ratio | Cross rollg ratio | Recrystalzn annealing conditions: Anneal condition | Heatg furnace | Heatg condn, °C. |
|---|---|---|---|---|---|---|---|---|---|---|---|
| This invention: | | | | | | | | | | | |
| 1 | 1150 | 1010 | 0 | 950 | Air | 800 | 1.33 | 1.01 | 950° C. × 1 hr | Air furnace | 950 |
| 2 | 1100 | 900 | 30 | 950 | " | 800 | 1.33 | 1.01 | 950° C. × 1 hr | Air furnace | 950 |
| 3 | 1100 | 900 | 30 | 950 | Vac*6 | 800 | 1.33 | 1.00 | 950° C. × 1 hr | Vac*6 furnace | 950 |
| 4 | 1100 | 900 | 30 | 950 | Ar*6 | 800 | 1.33 | 1.01 | 950° C. × 1 hr | Ar*6 furnace | 950 |
| 5 | 1100 | 900 | 30 | 950 | He*6 | 800 | 1.33 | 1.02 | 950° C. × 1 hr | He*6 furnace | 960 |
| Comparative: | | | | | | | | | | | |
| 6 | 1150 | 1010 | 0 | 950 | Air | 800 | 1.10 | 1.01 | 950° C. × 1 hr | Air furnace | 950 |
| 7 | 1150 | 1010 | 0 | 950 | " | 800 | 1.33 | 0.54 | 950° C.. × 1 hr | Air furnace | 950 |
| 8 | 1150 | 1010 | 0 | 950 | " | 800 | 6.40 | 0.99 | — | — | — |
| 9 | 1050 | 900 | 30 | 950 | " | 800 | 6.40 | 0.99 | — | — | — |
| 10 | 1050 | 900 | 30 | 950 | Ar*6 | 800 | 6.40 | 1.00 | — | — | — |
| 11 | 1050 | 900 | 30 | 1050 | Air | 900 | 1.33 | 1.01 | 1050° C. × 1 hr | Air furnance | 1050 |

| Example No. | 2nd rolling conditions (hot rolling): Heatg furnace | Finish temp., °C. | $\alpha$-$\beta$regn reducn ratio | Cross rollg ratio | Heat treatment | Mechanical properties*5: Tens. direction | Tens. str 0.2% y.s. (kgf/mm2) | (kgf/mm2) | Elongatn, % | Area redn, % | Rate of nonequiaxed crystal formatn, %*3 | Length of as-rolled surface cracks, cm*4 |
|---|---|---|---|---|---|---|---|---|---|---|---|---|
| This invention: | | | | | | | | | | | | |
| 1 | Air furnace | 800 | 4.80 | 1.01 | STA*1 | L*2 | 121.9 | 115.8 | 13.7 | 37.6 | 5.7 | 23 |
| | | | | | | T*2 | 122.1 | 115.8 | 13.9 | 40.2 | | |
| 2 | Air furnace | 800 | 4.80 | 1.00 | " | L | 123.0 | 116.5 | 14.6 | 41.9 | 2.9 | 3 |
| | | | | | | T | 122.7 | 116.8 | 14.2 | 40.8 | | |
| 3 | Vac*6 furnace | 800 | 4.80 | 0.99 | " | L | 123.1 | 117.4 | 15.1 | 42.3 | 1.4 | 0 |
| | | | | | | T | 123.3 | 117.1 | 14.9 | 38.6 | | |
| 4 | Ar*6 furnace | 800 | 4.80 | 1.01 | " | L | 123.6 | 117.3 | 15.3 | 43.5 | 4.3 | 0 |
| | | | | | | T | 123.0 | 116.9 | 16.2 | 44.8 | | |
| 5 | He*6 furnace | 800 | 4.80 | 1.00 | " | L | 122.5 | 116.7 | 14.7 | 40.0 | 2.9 | 0 |
| | | | | | | T | 122.9 | 117.2 | 15.4 | 42.0 | | |
| Comparative: | | | | | | | | | | | | |
| 6 | Air furnace | 800 | 1.50 | 1.00 | STA | L | 114.2 | 108.5 | 4.1 | 16.2 | 72.9 | 38 |
| | | | | | | T | 113.7 | 107.8 | 6.7 | 18.9 | | |
| 7 | Air furnace | 800 | 4.80 | 0.57 | " | L | 117.2 | 110.9 | 12.9 | 33.6 | 18.6 | 45 |
| | | | | | | T | 124.7 | 119.7 | 10.1 | 30.2 | | |
| 8 | — | — | — | — | " | L | 117.3 | 111.9 | 10.5 | 28.6 | 35.7 | 63 |
| | | | | | | T | 120.4 | 114.4 | 9.1 | 26.0 | | |
| 9 | — | — | — | — | " | L | 118.6 | 115.3 | 11.9 | 31.6 | 30.0 | 6 |
| | | | | | | T | 121.2 | 115.5 | 10.2 | 29.2 | | |
| 10 | — | — | — | — | " | L | 118.9 | 113.3 | 11.7 | 32.5 | 25.7 | 1 |
| | | | | | | T | 121.0 | 115.0 | 10.8 | 28.1 | | |
| 11 | Air | 900 | 4.80 | 0.99 | " | L | 119.1 | 113.0 | 2.8 | 12.4 | 100 | 134 |

TABLE 1-continued

| | | | | | |
|---|---|---|---|---|---|
| furnace | T | 120.9 | 115.0 | 3.6 | 10.8 |

Note
*[1]STA = 955° C. × 1.5 hr WQ + 538° C. × 6 hr AC. (Quenched size = 12 t × 60 w × 110 l).
*[2]L = direction parallel to the final rolling direction.
T = direction normal to the final rolling direction.
*[3]The microstructure of the cross section parallel to the final rolling direction of each test piece was photographed at 70 points chosen at random, and the percentage of the points where α crystals not equiaxed yet were found was determined. Each micrograph covered a field of 180 × 120 μm.
*[4]A total of the lengths (fisually determined) of surface cracks 0.5 mm or more in depth per 100 $cm^2$ of the surface area of each test piece.
*[5]Tensile test piece = 8.75 mm dia. × 35 mm GL.
*[6]Partial pressure of oxygen was always 0.02 atm. or below.

What is claimed is:

1. A method of manufacturing a rolled titanium alloy sheet which comprises breaking down an α or α+β titanium alloy ingot into a slab, working the slab in sequential stages of (A) cross rolling the slab in the α+β region under a condition of a reduction ratio of at least 1.2 and a cross rolling ratio of 0.6 to 1.4, (B) annealing the slab for recrystallization at a temperature 20° to 100° C. below the β-transus of the alloy, and (C) further cross rolling the slab in the α+β region under a condition of a reduction ratio of at least 1.6 and a cross rolling ratio of 0.6 to 1.4.

2. A method according to claim 1 further comprising repeating stages (B) and (C) at least one each.

3. A method of manufacturing a rolled titanium alloy sheet which comprises breaking down an α or α+β titanium alloy ingot by forging or rolling at a temperature of the two-phase α+β region under a total draft of at least 30% to form a slab, working the slab in sequential stages of (A) cross rolling the slab in the α+β region under a condition of a reduction ratio of at least 1.2 and a cross rolling ratio of 0.6 to 1.4, (B) annealing the slab for recrystallization at a temperature 20° to 100° C. below the β-transus of the alloy, and (C) further cross rolling the slab in the α+β region under a condition of a reduction ratio of at least 1.6 and a cross rolling ratio of 0.6 to 1.4.

4. A method according to claim 3 further comprising repeating stages (B) and (C) at least once each.

5. A method according to any of claims 1, 2, 3 or 4 wherein the recrystallization annealing in stage (B) that follows stage (A) is performed at a temperature 20° to 70° C. below the β-transus of the alloy.

6. A method according to any of claims 1, 2, 3, or 4 wherein the slab is heated to a temperature of the α+β region, prior to stage (A), in an atmosphere where the partial pressure of oxygen is no greater than 0.02 atm.

7. A method according to claim 5 wherein the slab is heated to a temperature of the α+β region, prior to stage (A), in an atmosphere where the partial pressure of oxygen is no greater than 0.02 atm.

8. A method according to claim 1 or 3 wherein the rolled slab is heat treated after stage (C).

9. A method according to claim 2 or 4 wherein the rolled slab is heat treated after stage (D).

* * * * *

UNITED STATES PATENT AND TRADEMARK OFFICE

CERTIFICATE OF CORRECTION

PATENT NO. : 4,581,077

DATED : April 8, 1986

INVENTOR(S) : Hideo Sakuyama, et al.

It is certified that error appears in the above—identified patent and that said Letters Patent is hereby corrected as shown below:

On the title page,

/73/ Assignee: add "Nippon Kokan Kabushiki Kaisha, Tokyo, Japan".

Signed and Sealed this

Fourth Day of November, 1986

[SEAL]

*Attest:*

DONALD J. QUIGG

*Attesting Officer*

*Commissioner of Patents and Trademarks*